US007536937B2

(12) United States Patent
Kawasaki et al.

(10) Patent No.: US 7,536,937 B2
(45) Date of Patent: May 26, 2009

(54) CUTTING METHOD OF FABRIC MATERIAL

(75) Inventors: Hidetoshi Kawasaki, Kanagawa (JP); Ken Shimizu, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 180 days.

(21) Appl. No.: 11/000,985

(22) Filed: Dec. 2, 2004

(65) Prior Publication Data

US 2005/0120842 A1 Jun. 9, 2005

(30) Foreign Application Priority Data

Dec. 5, 2003 (JP) ..... 2003-407695

(51) Int. Cl.
*B26D 7/10* (2006.01)

(52) U.S. Cl. ..... 83/16; 83/170

(58) Field of Classification Search ..... 83/170, 83/956, 15, 16, 171
See application file for complete search history.

(56) References Cited

U.S. PATENT DOCUMENTS 3,468,203 A * 9/1969 Armelin et al. ..... 83/433
3,751,281 A * 8/1973 Peterson et al. ..... 427/172
5,851,743 A * 12/1998 Akao ..... 430/501
2002/0022425 A1* 2/2002 Tsurumaki et al. ..... 442/352

FOREIGN PATENT DOCUMENTS

JP 01281896 A * 11/1989
JP 5-150407 A 6/1993
JP 10-130436 A 5/1998
JP 02001262108 A * 9/2001

OTHER PUBLICATIONS

Schreiber Translations, Inc., Cutting Method of Film: Translation of Ogiuchi et al (JP 01-281896), USPTO, pp. 1, 6 and 7.*

* cited by examiner

*Primary Examiner*—Kenneth E. Peterson
(74) *Attorney, Agent, or Firm*—Birch, Stewart, Kolasch and Birch, LLP

(57) ABSTRACT

A fabric material has a base fabric, a pile layer on a surface of the base fabric, and an adhesive layer of a hot-melt adhesive on another surface of the base fabric. The adhesive layer contains a wax whose melting point Tm1 is from 20° C. to 50° C. lower than the melting point Tm2 of the base polymer. The fabric material is heated by a heating device to at least (Tm1+5)° C. and (Tm2−5)° C., and then cut by a ultrasonic wave cutter 23. Thus the fabric material can be cut without generating the chaffs of the adhesive agent and the fiber offscums. As a result, the pollution is not made in the cutting process, and the cutting of the fabric material is made continuously and stably. Without the adhesion of the chaffs, the teremp which has a good surface formed by the cutting.

1 Claim, 3 Drawing Sheets

CUTTING METHOD OF FABRIC MATERIAL

BACKGROUND OF THE INVENTION

1. Field of the Invention

The present invention relates to a cutting method of a fabric material, and especially to a cutting method of a fabric material for producing a fabric called a teremp which is used as a light-trapping member in a patrone for a photographic film and the like.

2. Description Related to the Prior Art

A patrone for a 135 photographic film has a patrone main body made of a thin metal plate and a spool in the patrone main body, and around the spool a film strip having a predetermined length is wound up. The patrone main body is constructed of a cupper plate rolled to have a cylindrical shape, and a pair of caps. Both ends of the cupper plate extend in a tangent direction of the patrone to form a port with a slit-like outlet of the filmstrip between the both ends of the cupper plate. In order to prevent the entering of the outer light through the outlet into the patrone main body, a light-shielding fabric called a teremp is adhered to each inner wall of the port.

The teremp is constructed of a base fabric and a pile layer formed on the base fabric. The pile layer has a large number of soft thread-like pile threads, which is raised and contacts to the filmstrip not to damage or scratch a surface of the filmstrip when it is wound or unwound through the port. Thus the teremp has a light shielding property and prevent the bad influence on a photographic character in physical and chemical effects. Thus the several improvement of the teremp are made.

Usually, in the teremp in this use, the base fabric is woven by a warp and a weft, or has a textile structure having a chain thread and a inserting yearn, the pile threads are raised on a right surface of the base fabric, and a rear surface of the base fabric is coated with a hot-melt adhesive. A wide roll of a continuous fabric material produced as a whole cloth roll is slit to a width size predetermined in accordance with an object of use. Then, after the slitting, the fabric material is unwound from the roll, and the adhesion of the fabric material to the patrone main body was made. Then the fabric material is cut to teremp fragments having a predetermined length. Thereafter the teremp fragment is heated to the melting point of the hot-melt adhesive, and adhered to inner walls of the port.

As described above, there are two cutting processes (namely slitting and cutting the teremp) from unwinding the whole cloth roll to adhering the teremp onto the inner wall of the patrone. For example, in the slitting operation, as shown in FIG. 4, a cutter blade 101 is pressed through a pile layer 103 in a fabric material 102 for a teremp to cut a base fabric 104 and an adhesive agent layer 105 of a hot-melt adhesive. Thereby, chaffs of the hot-melt adhesive are generated in the slitting or the peeling. Before the cutting, the cutter or the fabric material is often previously heated (or preheated) in order to improve an adequacy of the cutting. However, if the heat temperature in the preheating step is not adequate for heat characteristics of each layer of the fabric material 102, high levels of dusts are generated. Thus in the cutting process, chaffs of the hot-melt adhesive can be easily generated, and such chaff remains on the teremp with adhesion even if the teremp is subjected to air blowing or to aspiration. If the teremp in this condition is adhered to the patrone, the teremp would damage the film surface and at least have an injurious effect on the photograph.

In order to resolve these problems, the Japanese Patent Laid-Open Publication No. 5-150407 teaches an improvement that the wide fabric material before the cutting is preheated at a temperature less than the melting point of the hot-melt adhesive and the waste textile generated from the pile thread and the warp and weft of the base fabric by cutting are trapped by the melt hot-melt adhesive. Further the Japanese Patent Laid-Open Publication No. 10-130436 discloses the mixing of the wax to the hot-melt adhesive in order to improve the physical properties, especially property of cold-resistant adhesion.

However, in the method of the publication No. 5-150407, it is necessary to heat the hot-melt adhesive at least to a predetermined temperature such that the waste textile are effectively trapped, and in accordance with the procedure of the melting, the effect of the adhesion of the adhesive agent becomes larger. Therefore the friction of the teremp to rollers or guide plates in a transporting path becomes larger. Otherwise, even if an ultrasonic cutter or a heated cutter may be used in the cutting process, the hot-melt adhesive melts. Therefore the friction of the hot-melt adhesive to the cutters becomes larger. Accordingly there is a demerit in the workability. Further, as described in the method of the publication No. 10-130436, it is known that several sorts of compounds, such as the wax and the like, are mixed in order to improve the physical properties of the hot-melt adhesive. However, the physical properties at cutting with use of the cutter are not considered.

SUMMARY OF THE INVENTION

An object of the present invention is to provide a cutting method of a fabric material without generation of chaffs of an adhesive agent which is applied to one surface of the fabric material.

In order to achieve the object and the other object, in a cutting method of a fabric material whose first surface is coated with a hot-melt adhesive containing a wax and a polymer as a main component, a combination of the wax and the polymer is determined such that a melting point Tm1 of the wax may be from 20° C. to 50° C. lower than a melting point Tm2 of the polymer. The first surface is previously heated such that a temperature thereof may be in the range of (Tm1+5)° C. to (Tm2−5)° C.

Preferably, the fabric material is cut into plural fabric sheets after heating the first surface. Further, a ultrasonic wave cutter is used for cutting the fabric material, and a fabric sheet is used as a light-shielding fabric such that a second surface may contact to a photosensitive material.

According to the invention, the fabric material having the adhesive layer of the hot-melt adhesive on the first surface can be cut with the ultrasonic wave cutter without generating the wax chaff. Thus a light-shielding teremp for a photosensitive material that has an adequate cut edges can be obtained without pollution of the cutting process.

BRIEF DESCRIPTION OF THE DRAWINGS

The above objects and advantages of the present invention will become easily understood by one of ordinary skill in the art when the following detailed description would be read in connection with the accompanying drawings.

PREFERRED EMBODIMENTS OF THE INVENTION

An embodiment of the present invention will be explained, first with respect to a fabric material, secondly with respect to a cutting method for producing a teremp, and thirdly with respect to the teremp itself. However, the present invention is not restricted to the specific embodiments employed in the explanation.

Figure 1:
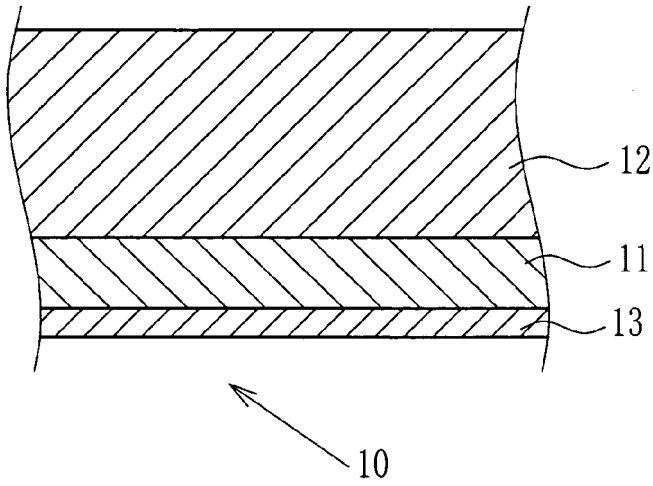
FIG. 1 is a sectional view of an embodiment of a fabric material used in the present invention.

In FIG. 1, a fabric material 10 used for producing a teremp has a base fabric 11, a pile layer 12 on one face of the base fabric 11, and an adhesive layer 13 of a hot-melt adhesive. In the pile layer 12, there are pile threads which are woven into the base fabric 11, and thus the pile layer 12 and the base fabric 11 are integrated. The adhesive layer 13 is formed by coating another face of the base fabric 11.

The base fabric 11 of this embodiment has a knit structure in which an inserting yarn is inserted into a chain yarn. The base fabric 11 are not restricted in the embodiment so far as it has properties in accordance with the use thereof, and the layers (such as the pile layer of this embodiment) are adequately formed in opposite side to the adhesive layer 13 of the hot-melt adhesive. For example, instead of the knit structure of the present invention, the base fabric 11 may have a woven structure constructed of the warp and the weft. Further, as the materials used for the base fabric 11, there are several sorts of known fibers, such as natural fibers, synthesized fibers and the like, namely the materials and the structures thereof are not restricted so far as they satisfy the several sorts of the mechanical properties (tensile strength, elastic modulus and the like) and the chemical properties (heat resistance and the like). Further, the formation property of the pile layer 12 and the adhesive layer 13 includes a property of forming the pile layer on the base fabric 11, a property of coating the base fabric 11 with the hot-melt adhesive, and the difficulty in peeling each formed layer from the base fabric 11. Accordingly, when the hot-melt adhesive is applied onto the base fabric 11 to form the adhesive layer 13, the adequate structure is selected from the textured and woven structures or in order to restrict the penetration of a solution of the adhesive agent into the base fabric 11. Further, in this case, sealing material may be provided in a side of the adhesive layer 13 in the base fabric 11.

The pile layer 12 has a polioerection structure in which the pile threads having the same length are disposed with a high density. As the materials used for the pile layer 12, the several sorts of the already known fibers (natural fibers, synthesized fibers and the like) can be used similarly to the base fabric 11. The materials and the structures of these fibers may satisfy the several sorts of the mechanical properties (scratch strength, elastic modulus and the like) and the chemical properties (heat resistance and the like). The synthesized fibers are preferably polyamide (for example, nylon-6, nylon-66, nylon-12 and the like, polyolefins (for example, polyethylene, polypropyrene and the like), polyesters (for example, polyethylene telephthalate and the like) and the like. In both case of the base fabric 11 and the pile layer 12, only the single one or the plural ones of the above materials may be used.

In this embodiment, the hot-melt adhesive is used for forming the adhesive layer 13, in order to adhere the fabric material 10 of the present invention to a patrone as a representation of the light-shielding housing for a recording materials. As the adhesive agent, there are a solution type, an organic solvent solution type, an emulsion type, a hot-melt type and the like. The hot-melt adhesive is in the solid state under the room temperature. Accordingly, the fabric material 10 is preserved in the situation that the adhesive layer 13 of the hot-melt adhesive is formed, and the hot-melt adhesive is excellent in the workability and the environmental preservation. Therefore, the hot-melt adhesive is preferably used among the above sorts of the adhesive agents.

The hot-melt adhesive is a nonsolvent type adhesive agent with 100% of the solid ratio, and the thermoplastic resin is the main component of the hot-melt adhesive. Concretely, the hot-melt adhesive usually has a necessary content of several compounds of tackifier and the thermoplastic polymer, and the anti-oxidant, plasticiser, filler or particles, wax and the like may be added if necessary. In the present invention, the hot-melt adhesive contains the base polymer and the wax, and the difference of the melting points between them may be a predetermined value. Thus the fabric material is cut adequately without generating dusts (including chaffs of the adhesive agent and the waste textile) under a predetermined cutting conditions which will be explained below. Note that the fabric materials of this embodiment are obtained by applying the hot-melt adhesive onto an opposite face of the base fabric to the face on which the pile layer is formed. The base polymer is used as the main content of the adhesive agent in order to keep the predetermined adhesive strength for a predetermined time, and the detailed explanation thereof will be made in the followings. Further, the wax is usually made for improving the workability, depending on objects thereof, namely, decreasing the melt viscosity of the hot-melt adhesive, preventing the threading of the hot-melt adhesive and the blocking at applying the adhesive agent, decreasing the time period from the start of the heating to the start of the melting (open time), and improving the heat resistance.

When Tm1 (° C.) is the melting point of the wax and Tm2 (° C.) is the melting point of the base polymer, the combination of the wax and the base polymer is determined in the present invention such that formulae $Tm1<Tm2$ and $20° C. \leqq (Tm2-Tm1) \leqq 50° C.$ are satisfied, and the fabric material 10 produced under the determination is cut in a cutting method explained in following, to have a predetermined size in accordance with the use. Thus only the wax can be melt easily while the base polymer is in the solid state. Therefore chaffs of the adhesive agent is not generated, and the produced fabric fragment which have adequate edges formed by the cutting and can be used as the teremp.

Incidentally, in the base polymer and the wax which can be used for the hot-melt adhesive, the molecular weight and the molecular structure of the compounds used as components of the invention are usually not same. In the measurement of the melting point of such compounds, the compounds do not have a specific melting point, but instead melt over a temperature range in which the temperature varies. In the present invention, the middle value of the temperature range is determined as each of the melting point Tm1 of the wax and the melting point Tm2 of the base polymer, and it is preferable to use the base polymer and the wax in which the highest and the lowest values of the temperature range are respectively 5° C. and −5° C. from the middle value of the respective temperature range.

Further, also when a mixture is used as the wax or a polymer mixture is used as the base polymer, the melting point Tm1 or Tm2 of the wax or the base polymer is preferably determined as follows. The highest and the lowest melting points among the compounds as the used components are obtained, and a middle value (averaged value) between the two melting points is regarded as the melting point Tm1 or Tm2 of the wax or the base polymer. The melting point can be measured in a method shown in JIS K6921-2 (differential scanning calorimetry (DSC)), and is measured in this method in this embodiment.

When the hot-melt adhesive containing the above wax and base polymer is used, the temperature control can be effectively made in the preheating for the cutting of the fabric material 10, independent from whether the base polymer or the wax is the single compound or the mixture. Therefore, the chaffs generated in the cutting don't adhere to the produced fabric fragment, and the peeling of the layer doesn't occur. Further, the pollution of the cutting process is prevented.

In the present invention, the adhesive layer 13 of the hot-melt adhesive preferably contains the wax in the range of 5 wt. % to 40 wt. %. Thus in the preheating in the cutting process described below, it becomes more easily to control the melting condition of the hot-melt adhesive at the predetermined temperature. Accordingly, it is prevented to generate of the waste textile and the fabric offscum by cutting and to adhere the hot-melt adhesive to a cutting device, and the fabric material can be cut to a fragment having an adequate cut edge. When the content of the wax is less than 5 wt. %, there are no effects of adding the wax. When the content is larger than 40 wt. %, the agglutinability of the hot-melt adhesive becomes lower such that the predetermined adhesive power cannot be obtained, and the fluidity becomes larger at the coating such that the adhesive agent may soak through the base fabric too much. Note that the content of the base polymer in the hot-melt adhesive is preferably in the range of 45 wt. % and 60 wt. %, and the content of the wax is particularly preferably in the range of 10 wt. % to 20 wt. %.

The compounds which can be used as the base polymer are several sorts of olefins (such as ethylene-vinyl acetate co-polymer (EVA), denatured ethylene-vinyl acetate co-polymer (denatured EVA), polyethylene (PE), polypropylene (PP) and the like), several sorts of polyamides (nylon and the like), several sorts of polyesters, ethylene-acrylate copolymer and the like. However, in the present invention, EVA and PE are preferable, and EVA is most preferable. Note that when PE is used, the degree of crystallization is preferably at least 65% such that the melting point may be at least 100° C. Thus, the compounds are more easily selected for preparing the adequate wax.

A content of vinyl acetate in the ethylene-vinyl acetate co-polymer is preferably in the range of 10 to 30 wt. %. Further, the ethylene-vinyl acetate preferably has a melt-index (or melt-flow rate (represented as MFR in this specification) in the range of 1 g/min. to 20 g/min. and a Vicat softening point in the range of 40° C. to 75° C. As an example of such preferable ethylene-vinyl acetate co-polymer, there is Ultracen #635 (trade name), produced by Tosoh Corporation)

When the content of the ethylene-vinyl acetate co-polymer is less than 10 wt. %, the adhesive strength in the low temperature becomes too small. Otherwise, when the content is larger than 30 wt. %, the fluidity decreases, and the coating the base fabric 11 cannot be made uniformly and stably. Further, when MFR is less than 1 g/min or the Vicat softening point is more than 75° C., an excessive load is applied to a resin extruding motor for extruding the hot-melt adhesive to the base fabric. Otherwise, when the MFR is larger than 20 g/min or the Vicat softening point is less than 40° C., the agglutinability of the hot-melt adhesive decreases such that the enough heat-resistance adhesion cannot be obtained and the hot-melt adhesive penetrates into the base fabric too much.

As the wax, a polyethylene wax is used in this embodiment. However, the wax is not restricted in it so far as having the above described functions. Other than polyethylene wax, there are, for example, paraffin wax, microcrystalyne wax, natural wax, synthesized wax and the like, and the single one or the mixture of them may be used.

To the hot-melt adhesive, preferably, the hot-melt adhesive provides the flowability, the tackness and the like and add a tackifier for increasing the adhesiveness. As the tackifier adequate to the hot-melt adhesive, it is usual to use amorphous oligomer whose molecular weight is from few hundreds to few thousands, and a predetermined quantity thereof is added such that the hot-melt adhesive may have objected properties, such as heat resistance, adhesiveness, melt viscosity, and the like.

As the tackifier, hydrogenated alicyclic petroleum resin is used in the present embodiment. In order to obtain the hydrogenated alicyclic petroleum resin as the tackifier, hydrogen is added to petroleum resin typetackifier to saturate the reactive double bonds. The supplies the hot-melt adhesive with a flowability and the tackness without making a bad influence on the photographic property, and supplies the effects for increasing the adhesive power. However, the present invention does not depend on the sorts and the composition rate of the tackifier, and the already known tackifier can be used for the hot-melt adhesive. The tackifier which can be used is categorized into natural resin type compound and synthesized resin compound. As the natural resin type compounds, there are rosin type compounds (such as rosin, rosin derivatives (for example, rosin hydride, disproportionated 不均化, polymerized, and esterified rosins) and the like), terpene type compounds (such as terpene resin (α-binene, β-binene), terpenephenol resin, aromatic denaturated terpene resin, terpen resin hydride and the like) and the like. Further, as the synthesized resin compound, there are petroleum resin, alkylphenol resin, xylene resin, coumaroneindene resin and the like. As the petroleum resin, there are not only aliphatic alicyclic hydride petroleum resin, but also aliphatic groups, aromatic groups, copolymerized petroleum resin and the like.

In the fabric material of the present invention, it is preferable to add several sorts of additives to the adhesive layer 13. As the additives, there are antioxidants for preventing the thermal deterioration during coating the base fabric with the hot-melt adhesive, inorganic particles for regulating the fluidity at the coating and the permeability into the base fabric, a blackening agent for increasing the light-shielding property, plasticizer and the like. Note that when these additives are added to the hot-melt adhesives, it is necessary that the additives never has a bad influence on the use of the base fabric of the present invention. For example, when the volatile compound can decrease the recording property of the recording material, it is forbidden to add a more than predetermined quantity of the volatile compound to the base fabric used as the light-shielding member of a light shielding case of the recording material.

The antioxidants to be used is the already known antioxidants described in Practical Encyclopedia of Plastics (Industrial Research Center) or Converting Material guide Book, vol. 1, 1991, (Converting Technical Institute). The antioxidants are representatively categorized into phenol type, thioether type and phosphor type on the basis of the chemical structure, and especially the phenol type is the most usual antioxidant. However, phenol type antioxidant sometimes has a bad influence on the film capability.

The inorganic particles are added such that the content thereof in the hot-melt adhesive after the addition may be at most 20 wt. %. Thus, the hot-melt adhesive has a good flowability and the penetration thereof is reduced so as to coat the base fabric well. Further, the addition of the inorganic particles increases the agglutinability of the adhesive agent and therefore increases the adhesive strength of the adhesive agent. When the content is more than 20 wt. %, the flowability decreases such that the coating with the hot-melt adhesive may be made worse and the adhesive strength decreases.

The preferable blackening compound to be added for increasing the light-shielding properties is, for example, carbon black. In this case, a predetermined quantity of the carbon black is added to the hot-melt adhesive, and thereafter it is necessary to knead the hot-melt adhesive to increase a degree of dispersion. Thus the fabric material can have an adequate light-shielding property. When the content of the carbon black is too small, the light-shielding effect is not enough. Preferably, the content to a weight of all components in the hot-melt adhesive after the addition is at least 0.2 wt. %. When the content is too large, the viscosity becomes too large at the applying, the adhesive power of the hot-melt adhesive becomes lower and the carbon black easily makes the agglutinability again. Therefore, the maximal content of the carbon black to the total components of the hot-melt adhesive is at most 1.0 wt. %. The present invention is not restricted depending on the sorts of the carbon black. For example, several sorts of the already known carbon blacks described in Handbook of Carbon Black (Tosho Shuppan-sya), preferably oil furnace black categorized with the production method and materials can be used.

The hot-melt adhesive can be produced by the several already-known producing method, and the present invention does not depends on the producing methods. For example, it is preferable that the carbon black or the antioxidant is added to a mixture of the above base polymer, wax and microparticle in a kneading method so as to knead them. Thus the dispersion is made enough.

Then the producing method of the fabric material of the present invention will be described in the following. After the hot-melt adhesive is applied to coat the base fabric 11, the teremp of the present invention can be produced by cutting the fabric material 10 in a cutting method described in followings. Note that a layer (the pile layer and the like) may be formed in an opposite side of the base fabric to the hot-melt adhesive, and the number of the formed layers is not restricted. As the preferable coating method of coating the base fabric 11 with the hot-melt adhesive, "The Coating Method (Yuji Harasaki, Maki Syoten)" teaches an extrusion coating method. Concretely, in this embodiment, the hot-melt adhesive is melt with heating with use of a heating cylinder, and the melt hot-melt adhesive is fed to a coating die. Then the hot-melt adhesive is extruded from the coating die onto the base fabric which is continuously transported. Thus the fabric material is obtained and cut in the cutting method described below.

The fabric fragment obtained from the above materials in the above producing method has an adequate adhesion to other materials, and has a cutting surface which is formed by cutting adequately. The already known cutting method can be applied to the present invention. However, the cutting can be made without generating the wax chaffs by the ultrasonic cutter and the heat cutter that are described in following.

Figure 2:
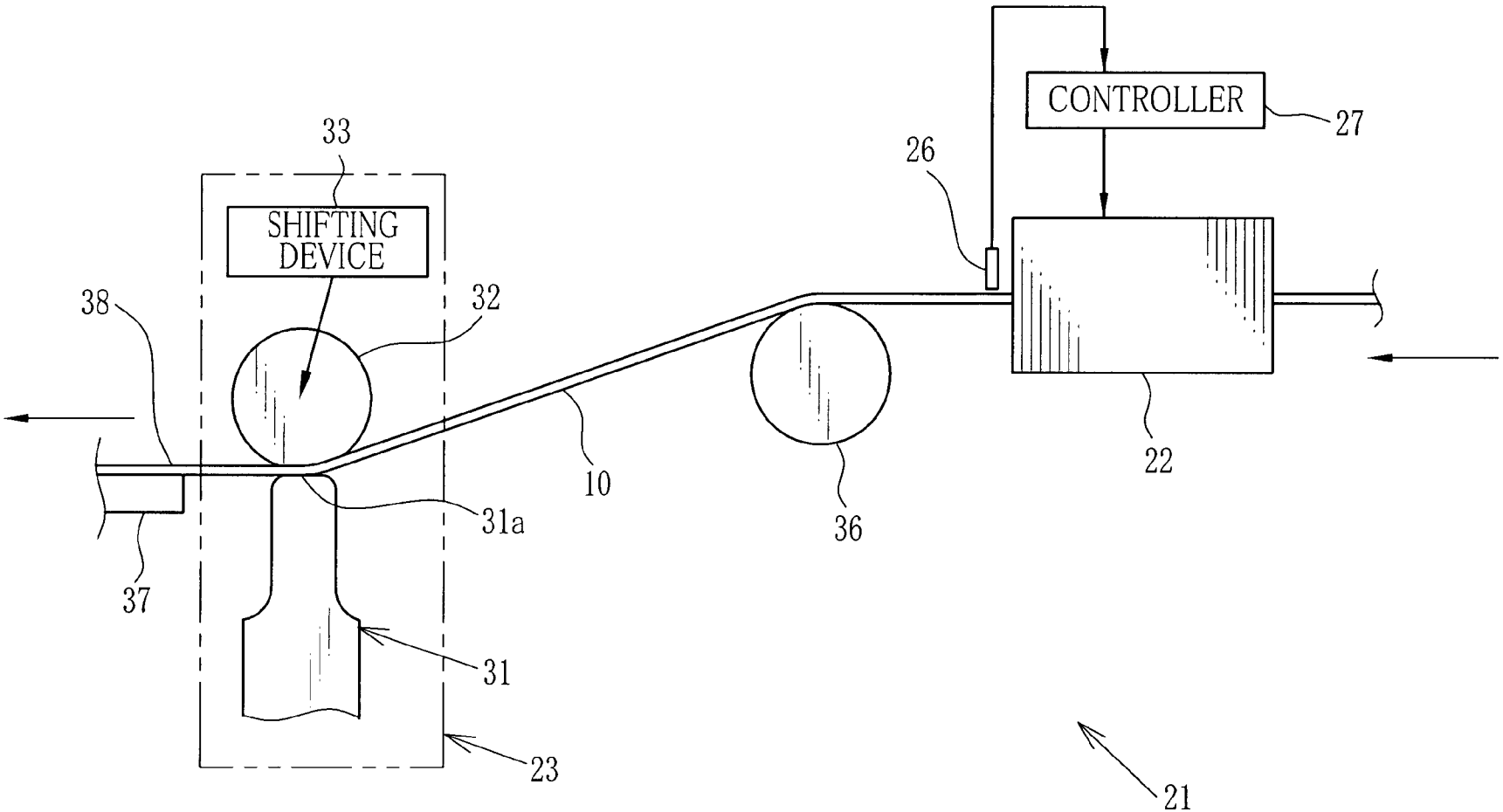
FIG. 2 is a schematic diagram illustrating a cutting process of the fabric material.
Figure 4:
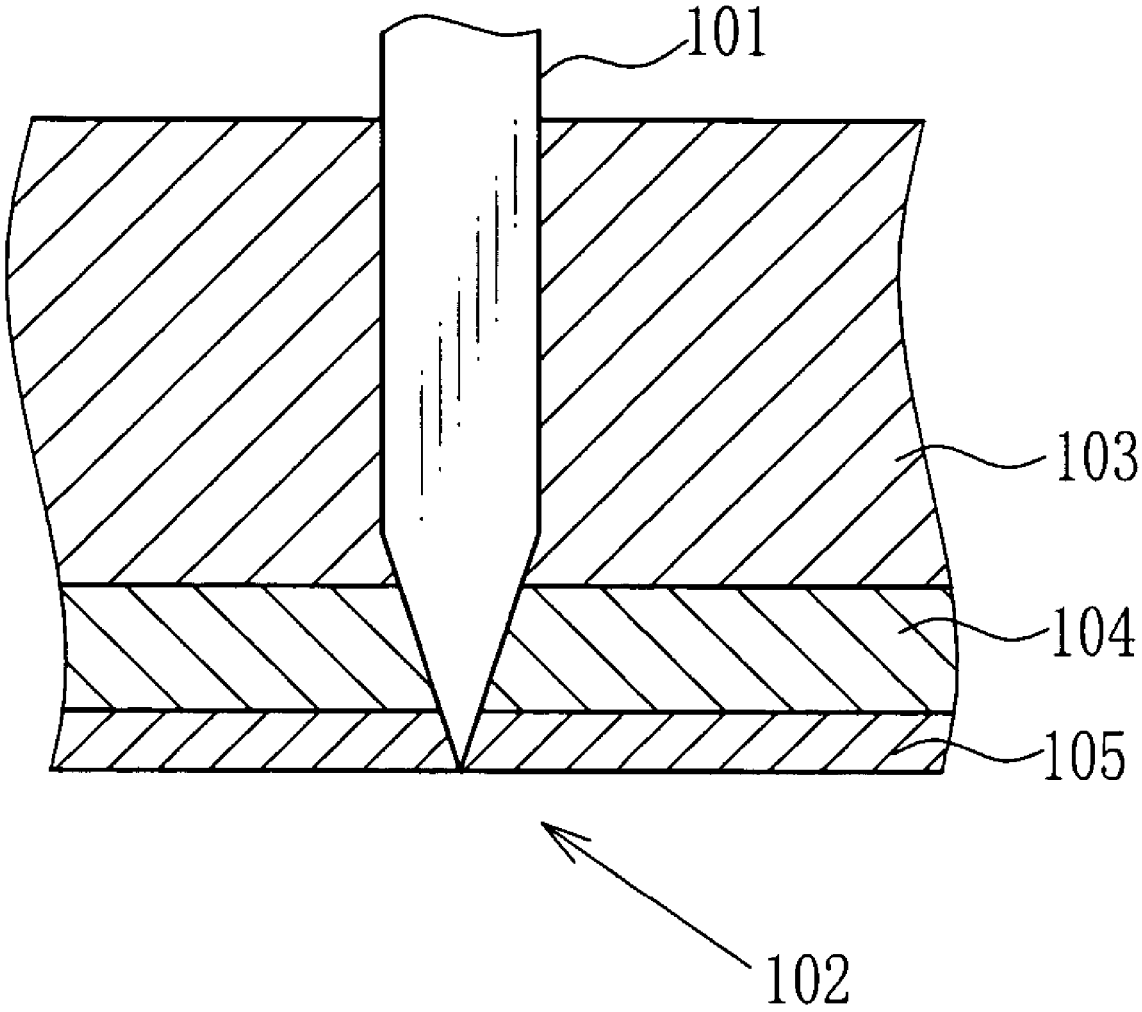
FIG.4 (PRIOR ART)
FIG. 4 is a sectional view illustrating a cutting method of a teremp of a prior art.

Then the cutting method of the fabric material will be described with reference to FIG. 2. In this embodiment, the fabric materials 10 are cut so as to have the predetermined width of the teremp.

A cutting device 21 has a heating device 22 for adjusting a temperature of the fabric material 10 and an ultrasonic wave cutter 23 for cutting the fabric material 10. The heating device 22 has an infrared ray temperature sensor 26 for detecting the temperature of the fabric material 10 around an exit of the heating device 22 without contacting the fabric material 10, and a controller 27 for controlling an inner temperature of the heating device 22 in accordance with a result of detecting the infrared ray temperature sensor 26. In the heating device 22, an electric current flows through a heating wire (not shown) provided in an inner wall so as to adjust the inner temperature.

Further, the ultrasonic wave cutter 23 includes a horn 31 as a vibrator (oscillator) for generating a supersonic wave and a round blade 32 provided with a shifting device 33. The horn 31 includes ceramic member called piezo elements, driving terminals, and earthing terminals, and an alternate voltage is applied to these terminals to vibrate the top of the horn at high speed. The shifting device 33 shifts the round blade 32 at a cutting position of the fabric material. The continuous fabric material 10 is continuously transported by a transporting devices (such as rollers 36 and the like) or supported by a supporting device (such as a guide plate and the like) which is provided if necessary. In FIG. 2, each one of the transporting devices and one of the supporting devices is shown for easiness of this figure.

In this embodiment, the fabric material 10 is cut with use of the cutting device 21 in the following method. The fabric material 10 transported toward the cutting device 21 passes at a predetermined speed in the heating device 22 for performing a preheating process, while the temperature in the heating device 22 is controlled to the predetermined value. Thus the temperature of the fabric material 10 is adjusted to a predetermined value adequate for cutting. Accordingly, the transporting time from the heating device 22 to the ultrasonic wave cutter 23 is preferably so short as possible. When the distance between the heating device 22 and the ultrasonic wave cutter 23 must be long after the special constraint for disposing the devices, the fabric material 10 is heated over the predetermined temperature with consideration of the temperature decrease. The temperature of the heated fabric material 10 is detected by the infrared ray temperature sensor 26 just after the heated fabric material is fed out from the heating device 22, and a data as a result of detecting is sent to the controller 27 for controlling the temperature of the heating device 22 in accordance with the result of detection. Thus the temperature of the fabric material 10 is continuously controlled. Note that another infrared ray temperature sensor is provided so as to measure the temperature of the fabric material 10 just before entering into the ultrasonic wave cutter 23, and the difference of the temperature to the exit of the heating device 22 is calculated. As a result, since the difference is at most 1° C., it is decided to regard the temperature at the exit of the heating device 22 as the temperature at cutting the fabric material. Thus the preheating can be made with consideration of the range of changing temperature from the heating device 22 to the cutting position.

Further, the preheating is made such that a temperature TP of the fabric material 10 at the cutting by the ultrasonic wave cutter 23 is at least (Tm1+5)° C. and at most (Tm2−5)° C. In this embodiment, as described above, the temperature of the fabric material 10 at an exit of the heating device 22 is regarded as the same as that just after entering into the ultrasonic wave cutter 23. Accordingly, the fabric material 10 is heated such that the temperature detected by the infrared ray temperature sensor 26 is at least (Tm1+5)° C. and at most (Tm2−5)° C. Therefore, for example, when the melting point Tm1 of the wax is 80° C. and the melting point Tm2 of the base polymer is 100° C., it is preferable to previously the fabric material 10 such that the detected temperature may be in the range of 85° C. to 95° C. Further, when the melting point Tm1 of the wax is 50° C. and the melting point Tm2 of the base polymer is 100° C., it is preferable to previously heat 55° C. to 95° C. At the cutting, if the detected temperature is less than (Tm1+5)° C., the hot-melt adhesive does not enough melt, namely the melt situation is less than the predetermined one. Accordingly, in this case, part of the hot-melt adhesive is peeled to adhere to the round blade 32. Therefore the adequate cut edges cannot be formed, and the waste textile from the pile layer and the chaff s of the adhesive agent adhere to the cutting surfaces. Otherwise, when the detected temperature is more than (Tm2−5)° C., the hot-melt adhesive is melt excessively to adhere to the round blade 32.

Since the fabric materials 10 is heated depending on the inner temperature of the heating device 22, the correctness of controlling the inner temperature has the largest influence on the phase condition. Accordingly, it is preferable that the inner temperature is in the range of ±6° C. from the objected value of the inner temperature. In this embodiment a re used not only the electrothermal heater as described above and a hot air heater satisfying the above conditions of the inner temperature to obtain the same effect. Note that the hot air heater is a heating device for heating the fabric material by blowing the air whose temperature and flow rate is adjusted to predetermined values to the fabric material transported in a transporting path. Otherwise, in the present invention, several sorts of already known heating device is used. If a difference from the inner temperature of the heating device 22 to the objected temperature is larger than +6° C. or smaller than −6° C., it is preferable to change the heating temperature or the components of at least one of the wax and the base polymer in the hot-melt adhesive.

Further, the fabric material 10 heated to the predetermined temperature is transported to the ultrasonic wave cutter 23 by the rollers 36, and cut on a top 31*a* of the phone 31 of the ultrasonic wave cutter 23 by the round blade 32 to have a predetermined width. Note that the cutting method is not restricted in the method with use of the ultrasonic wave cutter, and may be as an example a method with use of the heated cutter. In the latter method, the round blade is heated to a predetermined temperature to cut the fabric material 10 as a cutting object. Thus a teremp material 38 is obtained and sent downstream with support of a guide plate 37 and the like. Then the teremp material 38 is transported toward production process of a patrone or a winding apparatus by a transporting device.

As described above, the cutting method of the present invention, the temperature of the fabric material 10 is increased in the range of (Tm1+5) to (Tm2−5), and thereby only the wax is melt while the base polymer is in the solid state. Thus the teremp material 38 having the good cut edge surface without generating the wax chaff.

Further, in the prior cutting method for producing the teremp, part or total of the pile layer is peeled from the base fabric by the cutting (thereafter, the phenomena is called layer-delamination), or the waste textile are generated. However, in the present invention, the layer-delamination and the generation of the waste textile are not prevented. Furthermore, the cutting method of the present invention can be applied not only to the production of the teremp but also to the cutting of the several sorts of the fabric material having the hot-melt adhesive. Further, the fabric material with the hot-melt adhesive that is to be cut into the teremp material 38 is a multi-layer fabric having the pile layer and the base fabric of knit structure in this embodiment. However, instead of the fabric material may be used a fabric with multi-layer of a pile layer and the basic fabric of the textile fabric structure, a napped fabric after the nap-raising treatment on one surface of the base fabric, flocked cloth and the like.

Figure 3:
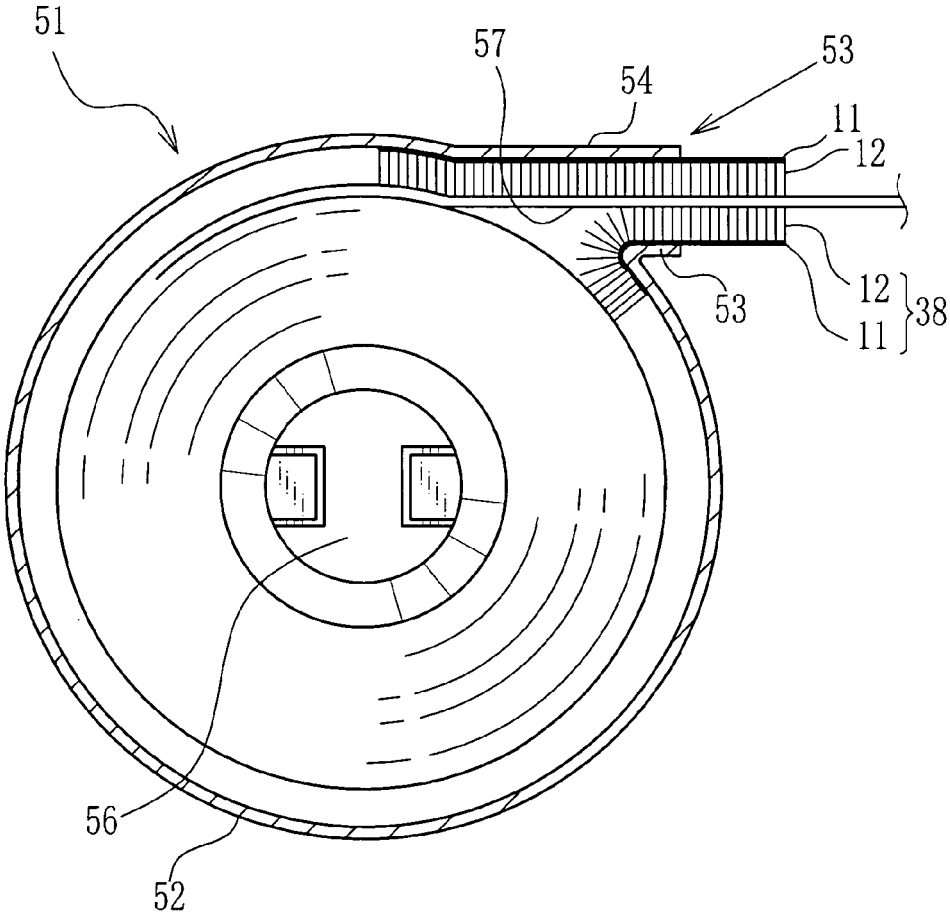
FIG. 3 is a sectional view of a patrone of 135 photographic film, in which a teremp is used.

The obtained teremp material 38 can be adequately used for a patrone for a photographic film. Namely, when the teremp material 38 is cut into a teremp fragment having a predetermined length without generating the fabric offscum, the chaffs of the hot-melt adhesive. The teremp fragment has adequate light-shielding properties. In FIG. 3, a film patrone 51 has a patrone main body 52 made of metal, and the patrone main body 52 is cylindrically shaped so as to have a port as an inner space formed by ends 53,54. The two teremp fragments are adhered to inner walls of the ends 53, 54 so as to contact each other. Note that the illustration of the hot-melt adhesive is omitted. The photo film 57 wound around a spool 56 is unwound and wound while the teremp fragments contact both surface of the photo film 57. Thus the light-shielding of the inner space of the film patrone 51 is made by the teremp fragment.

In this embodiment, the teremp material 38 is cut to have the predetermined width at first, and then cut to the teremp fragment having the predetermined length in consideration of the size of the exit of the film patrone 51. Thereafter, the teremp fragments are adhered to inner walls of a slit for the entering or exiting in the patrone main body 52. The cutting of the fabric material 10 into the teremp material 38 having the predetermined width and the cutting of the teremp material 38 into the teremp fragment having the predetermined length is made in the cutting method of the above embodiment. Further, at the adhesion, the patrone main body 52 is a metallic thin plate which is formed such that the section thereof may be nearly boat-shaped. However, the present invention is not restricted in the producing method of the patrone. For example, the plural metallic thin plates to be used for the patrone main body are sequentially transported in a situation that a back end of one plate is extremely closed to a front end of a next plate. Then the two continuous teremps 38 extending in a perpendicular direction to the transporting direction of the metallic thin plates are adhered to the both ends of the metallic thin plates. Thereafter, the cutting device (such as a cutter an the like) may be moved in a space between the neighboring thin plates to cut the teremp material 38. In this case, it is preferable to make the temperature control in the above described conditions.

EXAMPLE

<Experiment 1>

The hot-melt adhesive was extruded to coat an opposite surface of the base fabric 11 to the pile layer 12, such that the fabric material 10 having the three layer structure was produced as shown in FIG. 1. Note that the hot-mail adhesive agent was prepared from the following composition. A wax 1 has an averaged molecular weight Mw in the range of 6000 to 8000, and a melting point Tm1 at 70° C. Further, the melting point Tm2 of the base polymer was 100° C. Then the obtained fabric material 10 is cut with use of the cutting device 21 shown in the cutting device 21. The heating temperature by the heating device 22 was 85° C., and the fabric material 10 is cut with keeping the heating temperature by the ultrasonic wave cutter 23.

(Base Fabric and Pile Layer)

Base Fabric: Pile Knitted Web, Double Rashel Weave, 22 guage

- Chain Yarn; Made of Polyester, 84 dtex/36f (trade name; Semidull produced by Toyobo Co., Ltd)
- Inserting Yarn; Made of Polyester, 84 dtex/36f (Semidull (trade name) produced by Toyobo Co., Ltd)

Pile Layer: Pile yarn; Made of Polyester, 84 dtex/36f (trade name; Semidull produced by Toyobo Co., Ltd)

(Hot-Melt Adhesive)

Base Polymer: ethylene-vinyl acetate co-polymer 44 wt. % (degree of crystallization 45%, content of vinyl acetate 25%, MFR 5 g/10 min., melting point 100° C., Ultracen #635 (trade name), produced by Tosoh Corporation)

wax 1: polyethylene wax, 15 wt. %, (melting point 70° C. Petrolite #C-4040, produced by Toyo Petrolite KK)

Tackifier: aromatic type petroleum resin, 30 wt. %, (Petcoal #140, produced by Tosoh Corporation)

Micro particle: talc, 10 wt. %, (produced by Nippon Talc Co., Ltd.)

Carbon black: #44, 0.7 wt. %, (produced by Mitsubishi Chemicals Corp.)

Antioxydant: irganox #1010, 0.3 wt. %, (produced by Nippon Chibagaigii KK.)

After the cutting, the estimations of the following five articles 1-5 were made after the following criteria, and the results of the estimations are shown in Table 1.

Article 1: estimation with eyes of the generation of the chaffs of the hot-melt adhesive and the waste textile by cutting.

A; neither chaffs nor waste textile were not generated

B; chaffs and waste textile were generated in a permissible range in practice

N; chaffs and waste textile were generated too much

Article 2: estimation with eyes of the condition in which the wax was melt.

A; wax was melt enough and the chaffs of the hot-melt adhesive does not adhere to the circular cutter B; the melting of the wax was not enough but permissible N; the melting of the wax was not extremely enough Article 3: estimation with eyes of the condition in which the base polymer is melt.

A; the base polymer was melt enough and the waste textile of the hot-melt adhesive does not adhere to the circular cutter B; the melting of the base polymer was not enough but permissible N; the melting of the base polymer was not extremely enough Article 4: estimation with eyes of the pollution in the cutting process.

A; no pollution as the adhesion of the hot-melt adhesive was observed

B; pollution as the adhesion of the hot-melt adhesive was observed in a permissible range in practice N; pollution as the adhesion of the hot-melt adhesive was observed clearly Article 5: estimation of endurance in treatment of the fabric material.

A; hot-melt adhesive did not melt under 50° C. in two hours

N; hot-melt adhesive melt under 50° C. in two hours

TABLE 1

| | Articles of Estimation | | | | |
|---|---|---|---|---|---|
| | Article 1 | Article 2 | Article 3 | Article 4 | Article 5 |
| Ex. 1 | A | A | A | A | A |
| Ex. 2 | A | A | A | A | A |
| Ex. 3 | B | B | A | A | A |
| Ex. 4 | A | A | B | B | A |
| Ex. 5 | A | A | A | A | A |
| Co. 1 | A | A | N | A | A |
| Co. 2 | A | A | A | A | N |

[Experiment 2]

A wax 2 was used instead of the wax 1, and the heating temperature of the heating device 22 was 80° C. Other conditions were the same as in Experiment 1. Note that the averaged molecular weight Mw of the wax 2 was in the range of 4000 to 6000, and the melting point Tm1 was 60° C. In order to obtain the wax 2, the reforming of the wax 1 was made to adjust the melting point.

[Experiment 3]

The heating temperature of the heating device 22 was 65° C., and other condition was the same as in Experiment 2. The result are shown in Table 1.

[Experiment 4]

The heating temperature of the heating device 22 was 95° C., and other condition was the same as in Experiment 2. The results are shown in Table 1.

[Experiment 5]

A wax 3 was used instead of the wax 1, and the heating temperature of the heating device 22 was 75° C. Other conditions were the same as in Experiment 1. Note that the averaged molecular weight Mw of the wax 3 was in the range of 2000 to 4000, and the melting point Tm1 was 50° C. In order to obtain the wax 3, the reforming of the wax 1 was made to adjust the melting point.

[Comparison 1]

A wax 4 was used instead of the wax 1, and the heating temperature of the heating device 22 was 90° C. Other conditions were the same as in Experiment 1. Note that the averaged molecular weight Mw of the wax 4 was in the range of 8000 to 10000, and the melting point Tm1 was 80° C. In order to obtain the wax 4, the reforming of the wax 1 was made to adjust the melting point.

[Comparison 2]

A wax 5 was used instead of the wax 1, and the heating temperature of the heating device 22 was 70° C. Other conditions were the same as in Experiment 1. Note that the averaged molecular weight Mw of the wax 5 was in the range of 1000 to 2000, and the melting point Tm1 was 40° C. In order to obtain the wax 5, the reforming of the wax 1 was made to adjust the melting point.

The results of Experiments 1-5 and Comparisons 1,2 teaches that the chaffs of the adhesive agent does not adhere to the circular cutter and the offscums of the adhesive agent (such as wax offscums and the like) are not generated with the satisfaction of the following conditions. Namely, after a fabric is coated with the hot-melt adhesive in which the difference of the melting point between the wax and the base polymer is in the range of 20° C. to 50° C., the fabric is previously heated to at least (melting point of wax +5° C.) and at most (melting point of the base polymer −5° C.), and the cutting of the fabric is made. Further, under this condition, the waste textile are not generated from the pile layer and the like. Accordingly, the pollution is not made in the cutting process by the chaff of the adhesive agent, the fiber offscums, and the like. The obtained teremp has a high endurance of treatment and the sectional surface formed by the cutting is in a good condition.

Various changes and modifications are possible in the present invention and may be understood to be within the present invention.

What is claimed is:

1. A cutting method of a fabric material having a surface coated with a hot-melt adhesive, wherein said hot-melt adhesive comprises a polymer and from 5 to 40 weight-% wax, and wherein a melting point Tm1 of said wax is from 20° C. to 50° C. lower than a melting point Tm2 of said polymer, said cutting method including steps of:

pre-heating said coated surface such that a temperature thereof is in the range of (Tm1+5)° C. to (Tm2−5)° C.; and then cutting said fabric material while the temperature is controlled in the range of(Tm1+5)° C. to (Tm2−5)° C., wherein Tm1 is 70° C., Tm2 is 100° C., and the value for the expression (Tm1+5)° C. to (Tm2−5)° C. is 85° C.

* * * * *